US010100603B2

(12) United States Patent
Rondeau

(10) Patent No.: US 10,100,603 B2
(45) Date of Patent: Oct. 16, 2018

(54) MIXING SYSTEM FOR CEMENTING APPLICATIONS

(71) Applicant: SCHLUMBERGER TECHNOLOGY CORPORATION, Sugar Land, TX (US)

(72) Inventor: Joel Rondeau, Antony (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 361 days.

(21) Appl. No.: 14/932,341

(22) Filed: Nov. 4, 2015

(65) Prior Publication Data

US 2017/0122064 A1 May 4, 2017

(51) Int. Cl.

| | |
|---|---|
| ***E21B 33/14*** | (2006.01) |
| ***B28C 5/06*** | (2006.01) |
| ***B01F 5/00*** | (2006.01) |
| ***B01F 5/24*** | (2006.01) |
| ***B01F 15/00*** | (2006.01) |
| ***B08B 7/02*** | (2006.01) |

(52) U.S. Cl.

CPC ..... *E21B 33/14* (2013.01); *B01F 5/0057* (2013.01); *B01F 5/248* (2013.01); *B01F 15/00051* (2013.01); *B08B 7/02* (2013.01); *B28C 5/06* (2013.01)

(58) Field of Classification Search

CPC ..... E21B 43/12; E21B 43/121; E21B 33/14; B01F 5/0057; B01F 2003/125; A61K 9/1694

USPC ..... 366/165.1, 275

See application file for complete search history.

(56) References Cited

U.S. PATENT DOCUMENTS

| | | | | | |
|---|---|---|---|---|---|
| 1,781,255 | A * | 11/1930 | Trouth | B28C 5/1223 | 366/38 |
| 3,227,213 | A * | 1/1966 | Smith | E21B 33/02 | 166/292 |
| 4,093,028 | A * | 6/1978 | Brandon | B06B 3/00 | 166/281 |
| 4,386,806 | A * | 6/1983 | Axen | E21B 43/28 | 166/295 |
| 5,571,281 | A * | 11/1996 | Allen | B01F 3/12 | 366/163.1 |
| 2003/0081493 | A1* | 5/2003 | Allen | B01F 5/02 | 366/10 |

* cited by examiner

*Primary Examiner* — Mark Halpern

(74) *Attorney, Agent, or Firm* — Michael L. Flynn; Rachel E. Greene; Robin Nava

(57) ABSTRACT

A technique facilitates various types of cementing applications, such as a downhole cementing applications along a wellbore. The technique utilizes a mixer having a rigid body and a flexible skirt disposed along at least a portion of the interior of the rigid body. The mixer further comprises a cement blend inlet and a fluid inlet through which cement blend and fluid are introduced into the mixer to form a cement slurry. The flexible skirt is constructed to enable selective deformation, e.g. flexing, during formation of the cement slurry to reduce or prevent the formation of cement slurry caking within the mixer.

17 Claims, 4 Drawing Sheets

MIXING SYSTEM FOR CEMENTING APPLICATIONS

BACKGROUND

In a variety of downhole cementing operations, a cement slurry is mixed at a well site via a cement mixing system. The cement slurry is then delivered to a pumping system which is used to pump the cement slurry downhole into a wellbore. For example, the cement slurry may be delivered to a downhole location and forced under pressure into the annular space between a well casing and a surrounding wellbore wall. Upon curing, the well casing is cemented in place within the wellbore and the space between the well casing and the surrounding wellbore wall is sealed. When the cement slurry is mixed, substantial cement caking can occur within the cement mixing system, and the cement caking may lead to interruptions in mixing and/or less desirable cement quality.

SUMMARY

In general, the present disclosure provides a system and methodology for facilitating a cementing application. A mixer is provided with a rigid body and a flexible skirt disposed along at least a portion of the interior of the rigid body. The mixer further comprises a cement blend inlet and a fluid inlet through which cement blend and fluid are introduced into the mixer to form a cement slurry. The flexible skirt is constructed to enable selective deformation, e.g. flexing, during formation of the cement slurry to reduce or prevent the formation of cement caking within the mixer.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitates various cementing applications. According to an embodiment, a mixer is provided with a rigid body and a flexible skirt disposed along at least a portion of the interior of the rigid body. In various applications, the rigid body may have a conical bowl and the flexible skirt may be disposed at least in part along an interior of the conical bowl to form an internal, conically-shaped space for mixing. The mixer further comprises a cement blend inlet and a fluid inlet through which cement blend and fluid are introduced into the mixer to form a cement slurry. The cement slurry may then be discharged through a slurry exit, e.g. a slurry exit disposed generally at the bottom of the conically-shaped space.

The flexible skirt is constructed to enable selective deformation, e.g. flexing, during formation of the cement slurry to reduce or prevent the formation of cement caking within the mixer. In some applications, the rigid body comprises a gas inlet or inlets, e.g. air inlets, through which gas is selectively injected into the space between the rigid body and the flexible skirt. The gas may be injected in pulses, or in other suitable patterns, which cause the flexible skirt to deform, e.g. flex. The deformation displaces cement/slurry caking which could otherwise collect along the interior of the mixer. In some applications, the flexible skirt may be formed from an elastomeric material, e.g. rubber, which facilitates break-up of cement caking The cement/slurry caking may occur along interior surfaces of the mixer. The cement/slurry caking also may occur during various stages of the slurry mixing process due to water splashing or humidity coming into direct contact with the cement blend powder. The dynamic capability of the mixer via the selective deformation of the flexible skirt facilitates break-up of the cement cakes that could otherwise generate problems with respect to mixing and cement quality.

Figure 1:
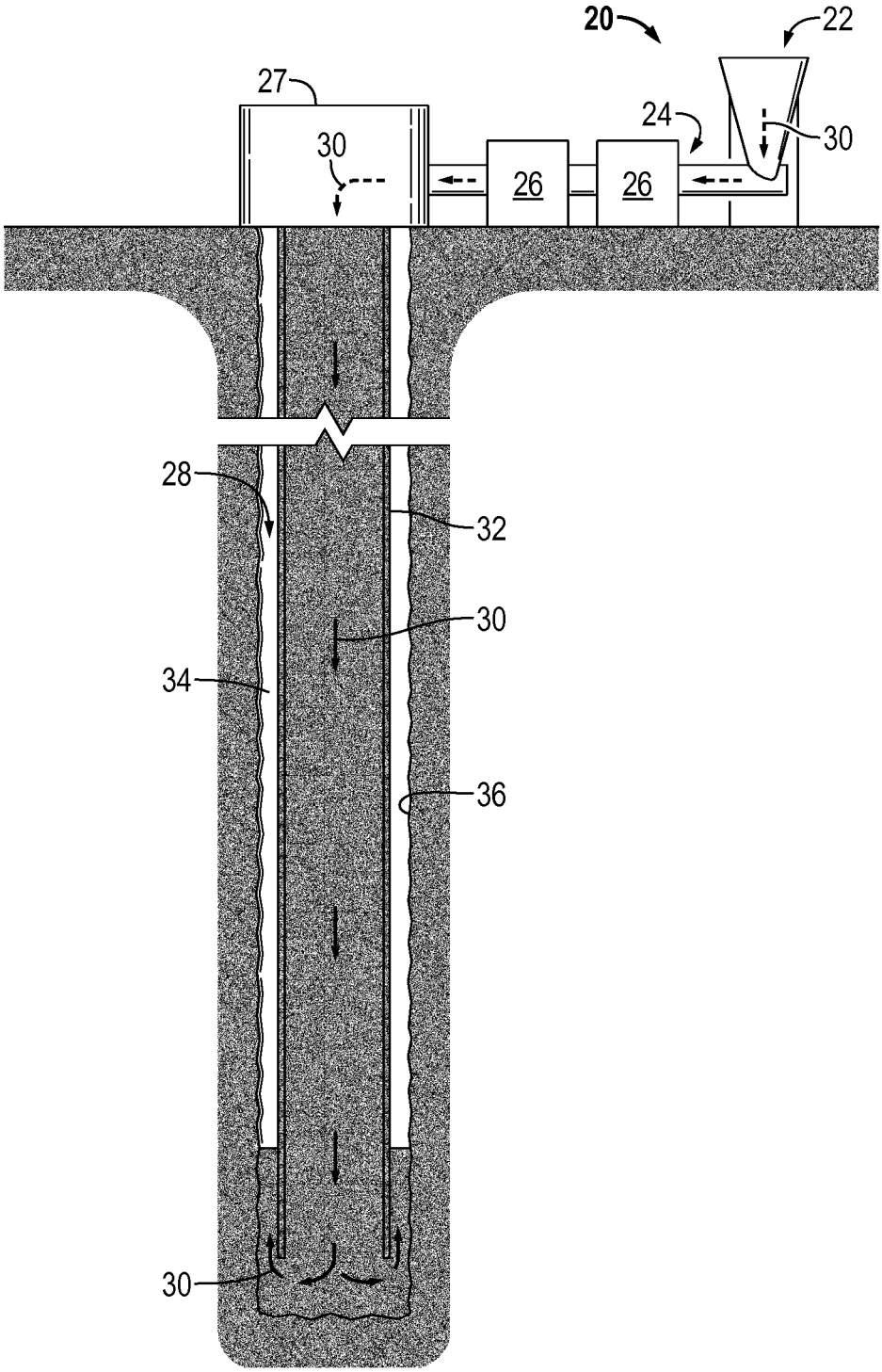
FIG. 1 is a schematic illustration of an example of a cementing system utilized in a well application for delivering a cement slurry downhole into a wellbore, according to an embodiment of the disclosure.

Referring generally to FIG. 1, an example of a cement mixing system 20 is illustrated as employed in a well cementing application. In this embodiment, the cement mixing system 20 comprises a cement mixer 22 used to form a cement slurry by mixing a powder cement blend with a fluid, e.g. liquid, to form a cement slurry. The powder cement blend may comprise cement and various other additives selected according to the parameters of a given cementing application. Similarly, the fluid may comprise a variety of constituents, e.g. water or water combined with desired additives.

In the embodiment illustrated, the cement slurry is mixed within cement mixer 22 and delivered to a pumping system 24 which may comprise one or more pumps 26. The pumps 26 are used to deliver the cement slurry to suitable surface equipment 27 and then downhole into a wellbore 28, as represented by arrows 30. By way of example, the cement slurry 30 may be delivered downhole through a tubing string 32, e.g. a casing string, to a desired location. In some downhole cementing applications, the cement slurry is delivered down through the tubing string 32 via suitable cementing equipment and forced into a surrounding annulus 34 between casing 32 and a wellbore formation wall 36. After the cement slurry 30 is dehydrated and cured, the remaining cement fills the desired portion of annulus 34. The cured cement secures casing 32 in place and provides a sealed barrier along the annulus 34. However, the cement slurry may be used in other cementing applications and with a wide variety of well equipment or other types of equipment.

Figure 2:
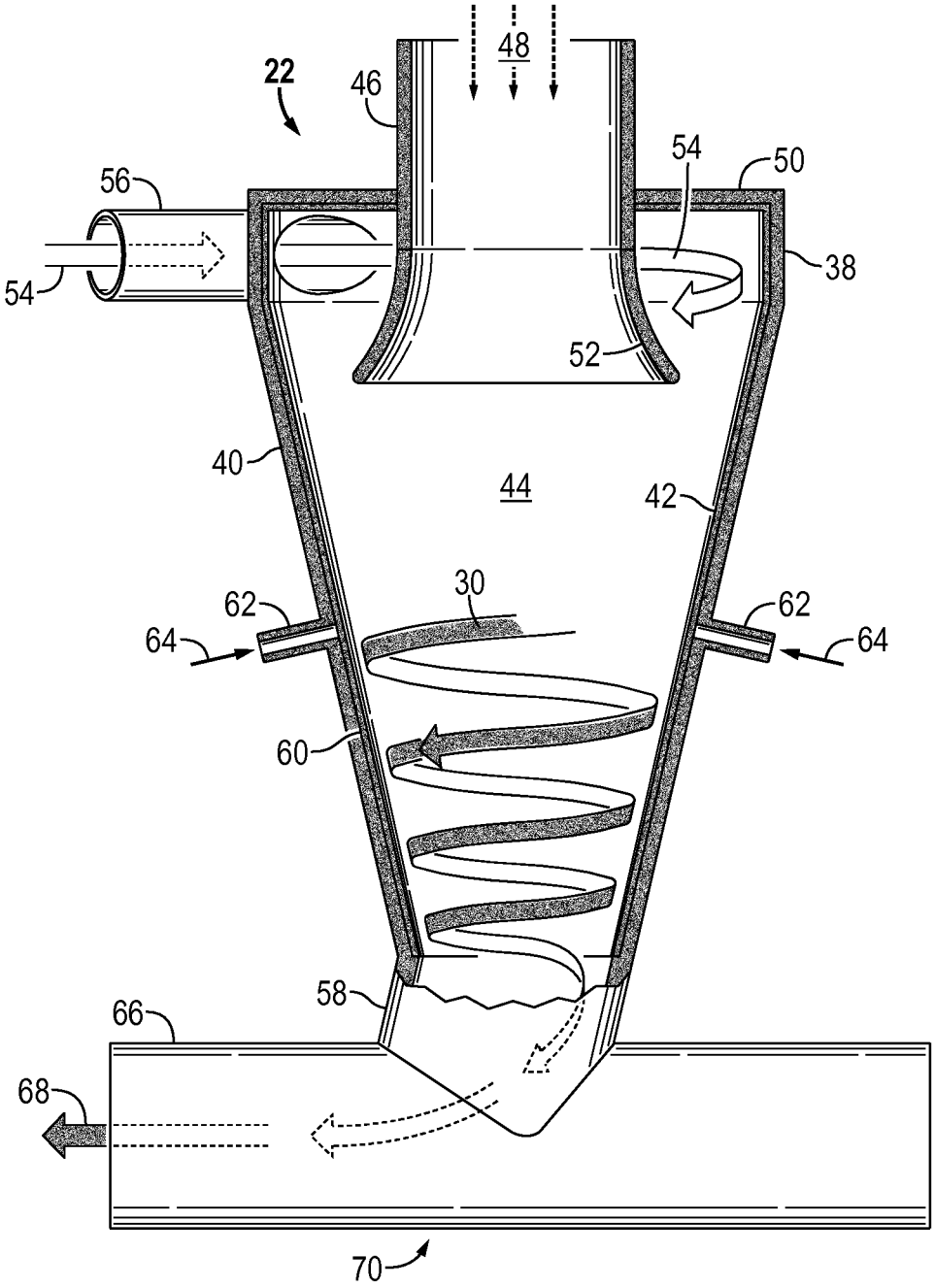
FIG. 2 is a schematic illustration of an example of the cementing system illustrated in FIG. 1, according to an embodiment of the disclosure.

Referring generally to FIG. 2, an embodiment of the cement mixer 22 is illustrated. By way of example, the mixer 22 may be used to mix the cement slurry 30 prior to delivery to pumps 26 of pumping system 24. In the embodiment illustrated, mixer 22 comprises a rigid body 38 which may have a conical bowl 40 to facilitate mixing and delivery of the cement slurry 30. The rigid body 38 may be formed of steel or another suitable rigid material or materials. A deformable inner skirt 42 is disposed along an interior of at least a portion of the rigid body 40. For example, the inner skirt 42 may be disposed along at least the conical bowl portion 40 of rigid body 38 to form a generally cylindrical interior 44 in which the cement slurry 30 is mixed. As illustrated, the inner skirt 42 may be disposed along the entire interior of rigid body 38 other than certain material inlets and exits.

In the embodiment illustrated, the mixer 22 further comprises a cement blend inlet 46 through which a cement blend powder 48 may be introduced into mixer 22, e.g. into interior 44, for mixing. Depending on the application, the cement blend inlet 46 may be positioned through a top portion 50 of rigid body 38 and may extend to interior 44 within flexible inner skirt 42. To facilitate the introduction of cement blend powder 48 and its mixing within mixer 22, the cement blend inlet 46 may comprise a flexible discharge 52. The flexible discharge 52 may be formed of, for example, an elastomeric material such as rubber. In the illustrated example, the cement blend inlet 46 and its flexible discharge 52 are formed in a trumpet shape.

Figure 3:
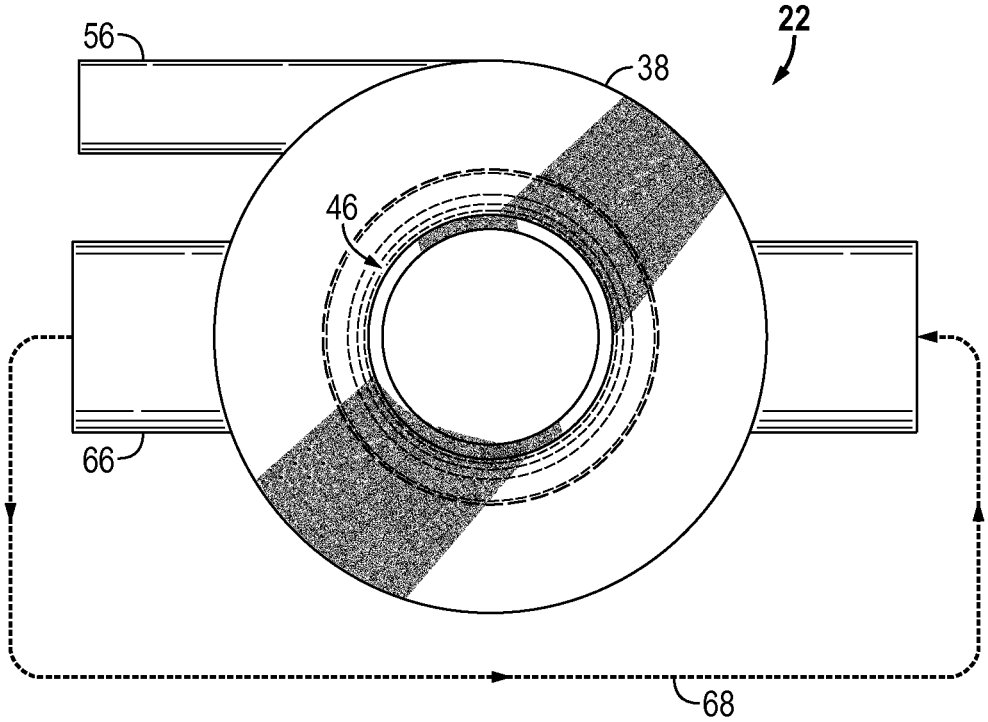
FIG. 3 is a top view of the cementing system illustrated in FIG. 2, according to an embodiment of the disclosure.

Consequently, cement blend powder 48 is delivered into mixer 22 through top portion 50 (see also the top view of FIG. 3). The flexible, e.g. rubber, trumpet shaped cement blend inlet 46 guides the cement blend powder 48 to interior 44 within conical bowl 40. The trumpet-shaped flexible discharge 52 protects the cement blend powder 48 from mixing before the dry powder particles meet a fluid 54, e.g. water or other suitable liquid, introduced through a fluid inlet 56. The trumpet-shape helps prevent plugging during delivery of the cement blend powder 48 into the conical interior 44.

The fluid inlet 56 may be positioned toward an upper end of the rigid body 38. By way of example, the fluid inlet 56 may be positioned below top portion 50 for introduction of fluid 54 at an upper end of the conical interior 44. In this example, the fluid inlet 56 is oriented to deliver the fluid 54 tangentially into the rigid body 38 and into the conical bowl 40. By way of example, the fluid inlet 56 may be positioned and oriented to deliver fluid 54 at a desired flow rate into interior 44 generally along a tangent with the interior of inner skirt 42. As illustrated, the fluid 54 is introduced into interior 44 along the top of conical bowl 40. According to an embodiment, the tangential flow of fluid 54 is injected into interior 44 at a sufficient flow rate to create a fluid vortex in interior 44 within conical bowl 40. The cement blend powder 48 may be introduced into the interior of the vortex to enhance mixing with fluid 54 and formation of the cement slurry 30.

In this latter embodiment, the conical bowl 40 is constructed to provide a meeting location, e.g. meeting point, between the mixing fluid 54 and the cement blend powder 48. In the specific example illustrated, the mixing fluid 54 is pumped tangentially into the interior 44 of conical bowl 40 such that the fluid swirls along the interior of inner skirt 42 within conical bowl 40 to an ingestion location for receiving the cement blend powder 48. In this example, the cement blend powder 48 is delivered generally through the middle of top portion 50 and into interior 44 within the vortex created by swirling fluid 54. After mixing the cement blend powder 48 with the mixing fluid 54 to form cement slurry 30 within interior 44, the cement slurry 30 may be discharged from the conical bowl 40 through a slurry exit 58. By way of example, slurry exit 58 may be disposed generally at a bottom end of the conical bowl 40 to facilitate discharge of the slurry 30.

The inner skirt 42 may be sealed with respect to the rigid body 48 to create a sealed pocket 60 between the rigid body 48 and the inner skirt 42. In some applications, the sealed pocket 60 may extend along the entire interior of rigid body 38 other than at inlets and exits, e.g. cement blend inlet 46, fluid inlet 56, and slurry exit 58. In some applications, the sealed pocket 60 may cover a portion of the interior of rigid body 38 when, for example, the inner skirt 42 is formed along a corresponding portion of the interior of rigid body 38. For example, the flexible inner skirt 42 may be sealed generally long the top and bottom of conical bowl 40. The sealed pocket 60 enables use of an actuating fluid, e.g. a gas such as air, to be injected into the sealed pocket 60 so as to deform, e.g. flex, the flexible inner skirt 42. The flexible inner skirt 42 may be selectively deformed to reduce cement/slurry caking during mixing of the cement slurry 30 within mixer 22.

As further illustrated in FIG. 2, the cement mixer 22 may comprise an injection inlet or inlets 62, e.g. a gas inlet or inlets. The inlets 62 are disposed through rigid body 38 to admit an actuating fluid 64, e.g. a suitable gas or liquid, into the pocket 60 between flexible inner skirt 42 and rigid body 38. By way of example, the inlet or inlets 62 may be positioned along conical bowl 40 of rigid body 38.

Referring again to the embodiment illustrated in FIGS. 2 and 3, the slurry exit 58 at the bottom of the conical mixing bowl 40 delivers slurry 30 into a supply line 66 which routes the slurry 30 to pumping system 24. In some applications, the cement mixer 22 may combine a recirculation line 68 (see FIG. 3) with supply line 66 to recirculate a portion of the slurry 30 back to slurry exit 58. In such an embodiment, a Venturi 70 may be formed by a suitable trough or nozzle and may be positioned along the recirculation line 68 at slurry exit 58. The Venturi 70 effectively creates a negative pressure which helps draw the cement slurry 30 out of the conical mixing bowl 40.

Figure 4:
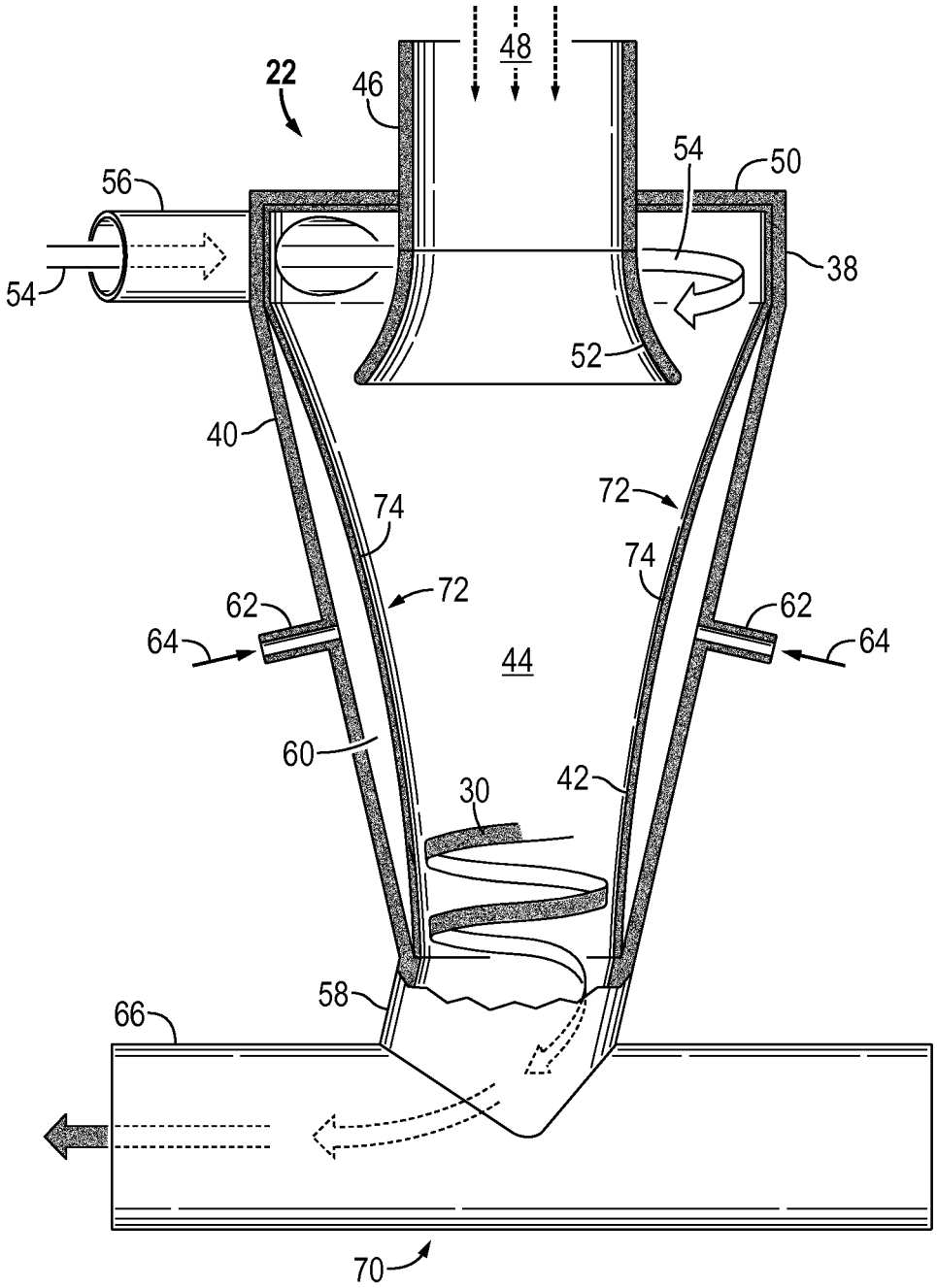
FIG. 4 is a schematic illustration similar to that of FIG. 2 but showing the cementing system in a different operational configuration, according to an embodiment of the disclosure.

In operation, the cement mixer 22 is able to mitigate cement/slurry caking without interrupting cement mixing. During mixing of cement slurry 30 within conical mixer bowl 40, actuating fluid 64 is injected between rigid body 38 and flexible inner skirt 42 via the inlet or inlets 62. In embodiments utilizing sealed pocket 60 between rigid body 38 and inner skirt 42, the actuating fluid 64 is selectively injected into the sealed pocket 60. The injection of actuating fluid 64 causes a deformation 72, e.g. a flexing, of deformable inner skirt 42, as illustrated in FIG. 4. The deformation 72 of inner skirt 42 prevents or releases slurry caking within the mixer 22, e.g. cement/slurry caking along the interior surface of inner skirt 42. By forming the inner skirt 42 of rubber or another suitable elastomeric material, the injection of actuating fluid 64 into pocket 60 increases an inner surface area 74 of the flexible inner skirt 42. The flexing and consequent increase in surface area 74 breaks up slurry caking to the extent slurry caking forms along the interior surface.

In a specific example, the injection fluid 64 is a gas such as air or other suitable gas. The gas, e.g. air, may be delivered through inlets 62 from a suitable pump, compressor, or other source of pressurized gas. Additionally, the injection fluid 64 may be delivered through inlets 62 with changing pressures. For example, the air or other injection fluid 64 may be pulsed periodically through inlets 62 so as to provide a pulsating inflation of the flexible inner skirt 42. However, the injection fluid 64 may be delivered through the inlet or inlets 62 according to other pressure delivery protocols suited to the parameters of a given cement mixing operation. It should be noted the flexible inner skirt 42 may be formed of rubber or other suitable materials selected so the cement slurry is less adhesive to the inner surface compared to metals such as steel.

The system and methodologies described herein also may be employed in non-well related applications in which cement is utilized. Additionally, the size and configuration of components used to construct cement mixer 22 may be adjusted according to the parameters of a given application and/or environment. In some applications, various sensors may be incorporated into the cement mixer 22 and those sensors may work in cooperation with a control system to enable intelligent control over injection of the actuating fluid 64. Various sensors also may be used to monitor aspects of the mixing to ensure formation of the desired cement slurry. The materials selected for the rigid components and the flexible components, e.g. inner skirt 42 and flexible discharge 52, may be adjusted according to environmental and operational parameters.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for cementing in a well, comprising:

a tubing string positioned in a wellbore to receive a cement slurry;

a pump to deliver the cement slurry to the tubing string; and a mixer to mix the cement slurry prior to delivery to the pump, the mixer having:

a rigid body comprising a conical bowl;

a cement blend inlet disposed at the top of the conical bowl to enable delivery of a powder cement blend into the conical bowl;

a fluid inlet oriented to deliver a fluid tangentially into the conical bowl; and an inner skirt disposed along an interior of the rigid body, the inner skirt being selectively deformable to reduce slurry caking during mixing of the cement slurry in the mixer.

2. The system as recited in claim 1, wherein the inner skirt is formed from an elastomeric material.

3. The system as recited in claim 1, wherein the inner skirt is formed from a rubber material.

4. The system as recited in claim 1, wherein the mixer further comprises a gas inlet positioned to enable injection of a gas into the conical bowl between the rigid body and the inner skirt, the inner skirt being deformed by selective injection of the gas.

5. The system as recited in claim 4, wherein the inner skirt is sealed with respect to the conical bowl to form a sealed pocket for receiving the gas.

6. The system as recited in claim 5, wherein the gas comprises air.

7. The system as recited in claim 1, wherein the cement blend inlet is in the form of a trumpet.

8. The system as recited in claim 1, wherein the cement blend inlet is formed at least in part of a flexible material.

9. The system as recited in claim 8, wherein the flexible material comprises rubber.

10. The system as recited in claim 9, wherein the cement blend inlet is oriented to deliver the powder cement blend into a vortex formed within the inner skirt during tangential delivery of the fluid into the conical bowl.

11. A system, comprising:

a mixer having a rigid body and a flexible inner skirt disposed along an interior of the rigid body, the mixer further comprising a fluid inlet, a powder inlet, and a gas inlet, the gas inlet being disposed through the rigid body at a location to enable delivery of a gas to a chamber between the rigid body and the flexible inner skirt for flexing of the flexible inner skirt.

12. The system as recited in claim 11, wherein the rigid body comprises a conical bowl and the flexible inner skirt is disposed along an interior of the conical bowl to create a conical interior space.

13. The system as recited in claim 12, wherein the powder inlet is disposed at a top of the conical bowl and a slurry exit is disposed at a bottom of the conical bowl.

14. The system as recited in claim 13, wherein the fluid inlet is oriented to deliver a slurry fluid into the mixer tangentially along an interior of the flexible inner skirt.

15. The system as recited in claim 14, wherein the mixer further comprises a recirculation passage positioned to recirculate slurry past a Venturi located at the slurry exit.

16. The system as recited in claim 12, wherein the flexible inner skirt is formed of rubber.

17. The system as recited in claim 12, wherein the powder inlet comprises a flexible portion extending into the flexible inner skirt.

* * * * *